US005100861A

United States Patent [19]

Gemmell et al.

[11] Patent Number: 5,100,861

[45] Date of Patent: Mar. 31, 1992

[54] THERMAL TRANSFER DYESHEET

[75] Inventors: Peter A. Gemmell, Bentley, United Kingdom; Kiyotaka Iiyama, Ibaraki, Japan

[73] Assignee: Imperial Chemical Industries PLC, London, England

[21] Appl. No.: 525,982

[22] Filed: May 21, 1990

[30] Foreign Application Priority Data

May 26, 1989 [GB] United Kingdom ..... 8912163

[51] Int. Cl.[5] ..... B41M 5/035; B41M 5/26

[52] U.S. Cl. ..... 503/227; 428/195; 428/524; 428/913; 428/914

[58] Field of Search ..... 8/471; 428/195, 500, 428/532, 913, 914, 524; 503/227

[56] References Cited

U.S. PATENT DOCUMENTS 4,720,480 1/1988 Ito et al. ..... 503/227

*Primary Examiner*—Bruce H. Hess

*Attorney, Agent, or Firm*—Cushman, Darby & Cushman

[57] ABSTRACT

A dyesheet for thermal transfer printing comprises a substrate supporting a transfer coat comprising one or more thermally transferable dyes dispersed throughout a polymeric binder comprising a mixture of polyvinylbutyral and a cellulosic polymer in which the percentage by weight of polyvinylbutyral lies within the range 65–85%.

3 Claims, No Drawings

THERMAL TRANSFER DYESHEET

The invention relates to the production of multicoloured images by dye diffusion thermal transfer printing, and in particular to dyesheets for such processes and to their manner of use.

Dye diffusion thermal transfer printing is a process in which thermally transferable dyes are caused to transfer from selected areas of a dyesheet to a receiver sheet held against it, by application of heat to those selected areas. Dyesheets generally consist essentially of a thin sheet-like substrate, supporting on one surface (its obverse surface) a transfer coat comprising a thermally transferable dye, usually held in a polymeric binder. Additional coatings may also be present, including for example adhesive subbing layers between substrate and transfer coat, and backcoats on the other (reverse) surface of the substrate for improving slip or heat resistant properties.

Printing is effected by heating selected discrete areas of the dyesheet while its transfer coat is pressed against a receiver surface of dye-receptive material, thereby causing dye to diffuse from the transfer coat into the corresponding areas of the dye-receptive surface. The heat for transferring the dyes can be supplied by printers having thermal printing heads which are pressed against the reverse surface of the dyesheet (or any overlying backcoat). Thermal printing heads have rows of tiny heaters, typically six or more to the millimetre, and these are selectively actuated intermittently according to electronic pattern-information signals received by the printer, to give individual pixels of the required print, the pattern so formed by these pixels thus being in accordance with the pattern-information signals. The electronic signal may be from a video, electronic still camera or computer, for example. The dyesheet may be elongated in the form of a ribbon and housed in a cassette for convenience, enabling it to be wound on to expose fresh areas of the transfer coat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are usually in the form of transverse panels, each the size of the desired print, arranged in a repeated sequence of the colours used. During printing, panels of each colour in turn are pressed against the dye-receptive surface of the receiver sheet, as the two sheets are passed together across the printing head to transfer the dye selectively where required, this colour being overprinted by each subsequent colour to make up the full colour image.

To enable prints to be made in this manner, the colours are provided by dyes which can diffuse through the binder and into the receiver sheet when heated. However, this inherent mobility can also enable them to migrate through the binder on storage at ambient temperatures, if other driving forces are present. These can include incompatibility between dye and binder, for example, and indeed we find that such migration can be influenced quite markedly by changes in the binder used. An effect of such migration can be accumulation of the dye at the surface of the binder layer, leading to crystallisation of the dye and uneven printing. Grease at the surface can exacerbate this effect and susceptibility to such migration can be demonstrated by momentarily pressing the transfer layer with an uncovered finger, a finger print appearing in the form of dye crystals in susceptible cases, accelerated by residual grease from the finger.

Popular binders capable of giving very good prints, are the cellulosic polymers such as ethyl cellulose and ethyl hydroxy-ethyl cellulose, but we have found that with many dyes, storage conditions are critical if the dyesheet is to maintain such capabilities for very long. When using the above test, we found that finger prints could appear almost immediately with a number of dye/cellulosic polymer combinations. Another binder known to be capable of giving good prints when stored under ideal conditions, is polyvinylbutyral, but although the problem is less severe with a polyvinylbutyral binder than with cellulosic binders, fingerprints could still develop within 24 hours, with susceptible dyes.

The use of polyvinylbutyral binders has previously been described for example in EP-A-141,678, which also suggests that in order to improve drying conditions, up to 10% by weight of cellulosic binders can be added to the polyvinylbutyral. We have now found that by adding substantially higher proportions of the cellulosic polymer to the polyvinylbutyral, susceptibility of the dye to migrate through the binder, can be reduced to a level which presents less of a problem than when either of such binder polymers is used separately.

According to the present invention, a dyesheet for thermal transfer printing comprises a substrate supporting a transfer coat comprising one or more thermally transferable dyes dispersed throughout a polymeric binder comprising a mixture of polyvinylbutyral and a cellulosic polymer in which the percentage by weight of polyvinylbutyral lies within the range 65–85%. The proportion of cellulosic polymer in this mixture is correspondingly within the range 35–15% by weight. For simplicity we prefer that the binder consists only of this mixture, but this does not preclude the addition to the binder of other polymers, provided the ratio of the polyvinylbutyral and cellulose in the mixture falls within the range specified.

Using accelerated ageing tests (as described hereinafter) to provide a measure of the dye migration, we find that there is generally less through polyvinylbutyral alone than through cellulosic polymers, but that when quantities of the cellulose are added to the polyvinylbutyral, the resultant mixture provides a binder through which there is even less migration. With little effect in very small quantities, increasing the cellulose polymer proportion to above about 15%, increasingly reduces migration of the dye. Even at the maximum proportion of 35% as specified above, the improvement is still in increasing.

However, we have found a further effect in combining polyvinylbutyral and cellulose polymers. The two polymers are only compatible when one or the other is in small quantities. This can be noticed as a surface roughness on the transfer coat, and on microscopical examination, separation of the two polymers may be seen. This can have the effect during printing of producing non-uniform images, and is therefore undesirable. This is a progressive effect which becomes noticeable with predominantly cellulosic binders as the polyvinylbutyral content reaches about 20% of the mixture. Unfortunately, dye-migration through cellulosic binders is generally higher than through polyvinylbutyral binders, and mixtures having polyvinylbutyral in the range 0–20% show little or no reduced dye-migration, compared with solely polyvinylbutyral binders. As the polyvinylbutyral content is increased, the effects of incompatibility pass through a maximum, to reduce to a usable level again when the mixture reaches about 65% polyvinylbutyral. At this level it can sometimes still be detected, but the high resistance to dye-migration which this level provides, may be more important than the slight residual incompatibility.

On reducing the cellulose content by a further 5%, we find that any remaining effects of the incompatibility become insignificant for most purposes, and our preferred polymeric binders are those in which the percentage by weight of polyvinylbutyral lies within the range 70–85%.

The substrate may be any sheet material having at least a smooth obverse surface and capable of withstanding the temperatures involved in dye diffusion thermal transfer printing, i.e. up to about 400° C. for periods of up to 20 ms, yet thin enough to transmit heat from the printer, right through to the dyes held in the binder, and thus to cause them to transfer to the receiver sheet in such short heating intervals. Examples of suitable materials include thin films of polymers such as polyesters, polystyrene, polyamides, polysulphones, celluloses and polyalkylenes, either alone or in laminates. Of these polymers, polyesters, especially biaxially orientated polyethyleneterephthalate films, are favoured for their stability in thin grades and the smooth surfaces that can be obtained. The thickness of the substrate sheet is suitably 3–20 μm, preferable less than 10 μm, and typically is about 6 μm. All coatings on the substrate, such as backcoats, subcoats and the transfer coats themselves, are similarly desirably as thin as possible while remaining operable, and are suitably in the range 0.5–3 μm, typically about 1 μm.

The dyesheet configuration we prefer is one wherein the substrate has an elongated ribbon shape, and the transfer coat comprises a plurality of different coloured dyes dispersed in the binder to form uniform coloured panels arranged as a repeated sequence along the length of the ribbon, each sequence containing a uniform panel of each colour. The preferred colours are yellow, magenta, cyan and optionally black (and thus are compatible with the present standard electronic colour signals), this sequence being repeated along the ribbon.

EXAMPLES 1–5

To illustrate the invention, a series of five dyesheets was prepared, the coating compositions comprising a magenta dye, polymer binder and tetrahydrofuran ("THF") as solvent. The proportions of dye, binder and solvent were kept constant throughout the series. However, the binder was a mixture of polyvinylbutyral ("PVB") and ethyl cellulose ("EC"), the ratios of which were varied as indicated in Table 1 below, expressing the compositions as percentages by weight of their constituents, and also showing the PVB as a percentage by weight of the binder.

TABLE 1

| Example | % Dye | Binder % PVB | Binder % EC | % THF | % PVB in binder |
|---|---|---|---|---|---|
| 1 | 4.0 | 4.8 | 1.2 | 90 | 80 |
| 2 | 4.0 | 4.2 | 1.8 | 90 | 70 |
| 3 | 4.0 | 3.6 | 2.4 | 90 | 60 |

TABLE 1-continued

| Example | % Dye | Binder % PVB | Binder % EC | % THF | % PVB in binder |
|---|---|---|---|---|---|
| 4 | 4.0 | 3.0 | 3.0 | 90 | 50 |
| 5 | 4.0 | 2.4 | 3.6 | 90 | 40 |

To produce dyesheets for testing, each composition was coated onto 6 μm thick polyethyleneterephthalate film, and dried. Those of Examples 3–5 in which 40–60% by weight of the binder was PVB, had rough surfaces to their coatings, and in appearance had significantly less gloss than those (Examples 1 and 2) with higher proportions of PVB. When used for printing, the samples with the rough surfaces gave prints of lower optical density, and non-uniformity of image quality, indicating that for successful thermal transfer printing these mixed binders need to contain greater than 60% by weight of PVB.

Similar mixtures of PVB with other cellulosic polymers were examined, these being ethyl hydroxy-ethyl cellulose, cellulose acetate, cellulose acetate proprionate, and cellulose acetate butyrate. Very similar results were obtained for them all.

EXAMPLES 6–20

The improved stability of dyesheets according to the invention is illustrated by the following examples, of which Examples 6, 10, 11, 15, 16, and 20 (using only cellulose or polyvinylbutyral as binder) are reference examples outside the scope of the present invention, and are provided for comparison purposes. In all these examples, a series of transfer coat compositions were prepared with a number of different binders, coated onto a normal substrate, dried and the resultant transfer layer evaluated for stability to fingerprint grease under accelerated ageing conditions.

All the compositions had essentially the same formulation as follows, where all quantities are expressed as percentages by weight:

dye 3.33%
binder 6.67%
solvent 90.00%

The dye used in each case was the same disperse magenta dye as that used in the preceding examples, with tetrahydrofuran similarly being used as solvent. The composition of the binder was varied with examples of PVB/EC binders having PVB contents greater than 60% by weight, in accordance with the findings of Examples 1–5 above. These are compared with examples using 100% PVB and 100% ethyl cellulose binders, as indicated in the table of results below (Table 2). The two polymers used were BX-1 from Sekisui (PVB), and EC-T100 from Hercules (EC).

The technique used was to prepare a solution of the dye and binder in the THF by stirring overnight. The resultant solution was coated on a standard base film using a K3 Meyer bar, and the solvent allowed to evaporate to give a series of dyesheets with uniform thin coatings which were essentially the same in each sheet except for the composition of the binder used.

The optical density of each dyesheet was measured in reflection with a Sakura microdensitometer, with a white card behind the dyesheet. A human finger was then applied briefly to the coated surface of each dyesheet to leave a fingerprint, and the dyesheet exposed to accelerated ageing conditions for 16 hours. Three different ageing conditions were used on samples from each dyesheet, and these are detailed in the table of results below, the variations being in the temperature and in the relative humidity ("RH").

After ageing, the optical densities of the fingerprinted areas were again measured, and as a measure of the change in composition with age, the percentage drop in optical density was calculated for each sample. The results are given in the table below.

TABLE 2

| Example | % PVB | % EC | Ageing Conditions | | % OD Change |
|---|---|---|---|---|---|
| 6 | 0 | 100 | 45° C., | 85% RH | 53.2 |
| 7 | 70 | 30 | " | " | 41.0 |
| 8 | 80 | 20 | " | " | 50.7 |
| 9 | 85 | 15 | " | " | 50.0 |
| 10 | 100 | 0 | " | " | 52.5 |
| 11 | 0 | 100 | 55° C., | 60% RH | 43.5 |
| 12 | 70 | 30 | " | " | 29.3 |
| 13 | 80 | 20 | " | " | 39.7 |
| 14 | 85 | 15 | " | " | 38.9 |
| 15 | 100 | 0 | " | " | 43.3 |
| 16 | 0 | 100 | 75° C., | ambient RH | 50.7 |
| 17 | 70 | 30 | " | " | 28.1 |
| 18 | 80 | 20 | " | " | 31.3 |
| 19 | 85 | 15 | " | " | 35.8 |
| 20 | 100 | 0 | " | " | 45.1 |

As will be seen from the results in Table 2, ageing occurred in all samples, including those with a binder composition of mixed polymers, but in each set of ageing conditions, those samples with a mixed binder composition according to the invention, consistently showed less deterioration than those using either of the constituent polymers alone, the improvement increasing progressively as the PVB is reduced from about 85%, down towards the levels at which surface roughness starts to become a problem, as shown in Examples 1–5.

We claim:

1. A dyesheet for dye diffusion thermal transfer printing, comprising a substrate supporting a transfer coat comprising one or more thermally transferable dyes dispersed throughout a polymeric binder comprising a mixture of polyvinylbutyral and cellulosic polymer, wherein the percentage by weight of polyvinylbutyral in the mixture lies within the range 65–85%.

2. A dyesheet as claimed in claim 1, wherein the percentage by weight of polyvinylbutyral in the mixture lies within the range 70–85%.

3. A dyesheet as claimed in claim 1, wherein the substrate has an elongated ribbon shape, and the transfer coat comprises a plurality of different coloured dyes dispersed in the binder to form coloured panels arranged as a repeated sequence along the length of the ribbon, each sequence containing a uniform panel of each colour.

* * * * *